US006913730B2

(12) United States Patent
Moriarty et al.

(10) Patent No.: US 6,913,730 B2
(45) Date of Patent: Jul. 5, 2005

(54) STOPPER ROD

(75) Inventors: Brendan Mortimer Moriarty, Paisley (GB); François-Noël Richard, Chatenois (FR); Eric Hanse, Feignies (FR)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 10/479,533

(22) PCT Filed: Jun. 6, 2002

(86) PCT No.: PCT/BE02/00092

§ 371 (c)(1),
(2), (4) Date: Dec. 3, 2003

(87) PCT Pub. No.: WO02/100578

PCT Pub. Date: Dec. 19, 2002

(65) Prior Publication Data

US 2004/0145096 A1 Jul. 29, 2004

(30) Foreign Application Priority Data

Jun. 8, 2001 (EP) ..... 01870120

(51) Int. Cl.[7] ..... B22D 41/10
(52) U.S. Cl. ..... 266/272; 222/597; 222/602
(58) Field of Search ..... 266/272; 222/591, 222/597, 601, 602; 164/437, 337

(56) References Cited

U.S. PATENT DOCUMENTS 4,610,436 A * 9/1986 LaBate et al. ..... 266/272
4,706,944 A 11/1987 Lee
5,024,422 A 6/1991 Fishler
5,259,596 A * 11/1993 Ruffaldi ..... 222/602

FOREIGN PATENT DOCUMENTS

EP 0625391 A1 11/1994
EP 1 160 030 A1 5/2001
GB 2210305 A * 6/1989 ..... 222/602

* cited by examiner

*Primary Examiner*—Scott Kastler
(74) *Attorney, Agent, or Firm*—Robert S. Klemz, Jr.; Donald M. Satina; James R. Williams

(57) ABSTRACT

There is provided a refractory mono-block stopper of substantially cylindrical configuration having an upper end, a lower end and an axial bore extending downwardly from the upper end, means being provided in the axial bore at a distance d from the upper end for attachment of the stopper to a lifting mechanism, the stopper being divided into three portions (A,B,C); a first portion (A) extending from the upper end towards the lower end until a distance greater than d, a second portion (B) extending from the first portion (A) towards the lower end and a third portion (C) extending from the second portion (B) and comprising a stopper nose ending at the lower end of the stopper. The stopper of the invention is characterized in that the average section of the second portion (B) is lower than the section of the first portion (A) and the highest section of the third portion (C) is higher than the lowest section of the second portion (B).

The stopper of the invention has a significantly reduced weight without any observable loss of strength. It is also noted that since the profile of the stopper can be kept symmetrical around its axis, the stopper does not require extra handwork to be removed from the mold.

13 Claims, 1 Drawing Sheet

STOPPER ROD

FIELD OF THE INVENTION

This invention relates to a stopper used as part of a valve mechanism in the control of flow of molten material from a vessel through a submerged outlet. More particularly, it relates to refractory mono-block stoppers, i.e. one piece ceramic stopper rods as currently used to control the flow of molten metal exiting from a nozzle mounted in the bottom of a melt-containing vessel, e.g. ladle or tundish. This is typically applied in the casting of steel through an opening in the base of the tundish via nozzles and shrouds into a water-cooled mould.

BACKGROUND OF THE INVENTION

Typically, such stoppers consist of an elongate cylindrical refractory ceramic body of isostatically-pressed graphite/alumina having at the lower end a rounded or tapered profile (the stopper nose) suitable for engagement in the throat of a corresponding exit nozzle, and at the upper end some form of connecting means to fasten the stopper onto an external lifting mechanism by which the flow is controlled.

Operation of the stopper is simple in principle. A mechanical lifting system is used to vertically lift the stopper rod from a seating position on the nozzle to ease or restrict the volume of the molten metal flowing through the nozzle. However, in practice, such a stopper rod has to operate under harsh environmental conditions such as being submerged in the molten metal for long periods of time and must be able to withstand the high thermal shocks encountered in the pouring processes.

The cost of a stopper is essentially due to handwork and the quantity of refractory material. Attempts have already been made to reduce the cost by reducing the weight of the stopper. In such a case, care must be taken to avoid loss of strength. EP-A-625,391 discloses a fluted stopper, the outer surface of which being provided with a number of axial grooves. The exterior surface of the stopper has an undulating contour comprising alternate lobes and recesses to provide a fluted design which is said to retain the strength of a regular cylindrical stopper. However, the time needed to remove the stopper from its complex mould, largely overbalance the economy of refractory material.

It is therefore desirable to provide a stopper with a design allowing to use less refractory material without loss of strength while keeping the handwork as low as possible. The present invention aims to provide an improved stopper fulfilling these objectives.

SUMMARY OF THE INVENTION

According to one aspect of the present invention there is provided a refractory mono-block stopper of substantially cylindrical configuration having an upper end, a lower end and an axial bore extending downwardly from the upper end, means being provided in the axial bore at a distance d (d being at the middle of the attachment means) from the upper end for attachment of the stopper to a lifting mechanism, the stopper being divided into three portions (A,B,C); a first portion (A) extending from the upper end towards the lower end until a distance greater than d, a second portion (B) extending from the first portion (A) towards the lower end and a third portion (C) extending from the second portion (B) and comprising a stopper nose ending at the lower end of the stopper. The stopper of the invention is characterized in that the average section of the second portion (B) is lower than the section of the first portion (A) and the highest section of the third portion (C) is higher than the lowest section of the second portion (B).

DETAILED DESCRIPTION OF THE INVENTION

Figure 1:
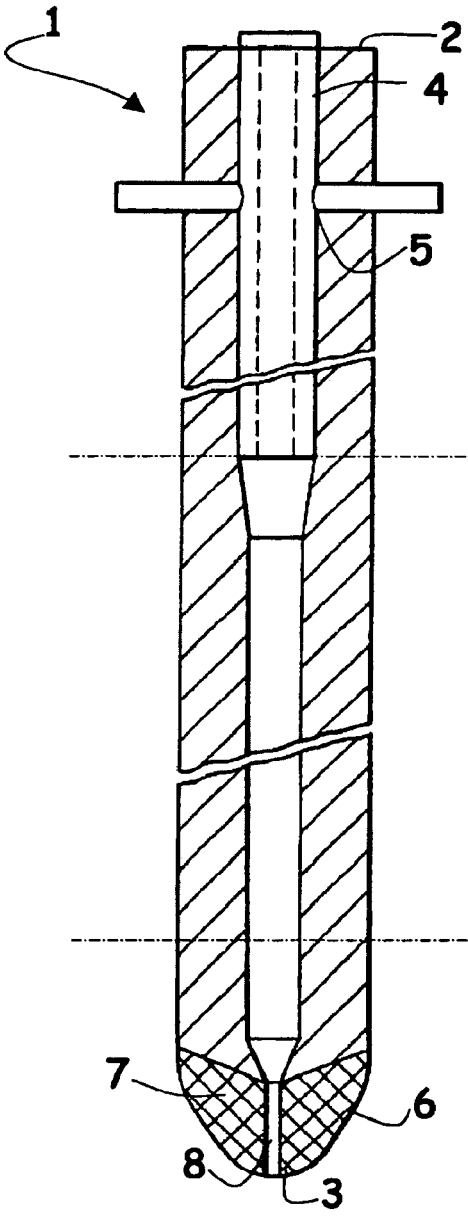
Fig. 1 (Prior Art)
FIG. 1 is a schematic view of a prior art stopper.

The present invention is based on the observation that the highest stressed point in a stopper is generally located around the means for attachment of the stopper to a lifting mechanism (at a distance which is generally greater than d from the upper end). Contrarily to the idea generally admitted in the art, the present inventors have perceived that it is not necessary to have an important thickness of refractory material all along the stopper to ensure that it can withstand the harsh working conditions placed upon it. Therefore, they have retained the conventional thickness of refractory material around the means for attachment of the stopper to a lifting mechanism (first portion) and around the nose of the stopper (third portion) which must remain suitable for engagement in the throat of a corresponding exit nozzle while reducing the thickness of refractory material in the intermediate portion (second portion) thereby reducing significantly the weight of the stopper without any observable loss of strength.

It would be possible to also reduce the dimension of the third portion, however, preferably, the highest section of the third portion (C) is higher than the average section of the second portion (B) so that the nose of the stopper (third portion) remains suitable for engagement in the throat of a corresponding conventional exit nozzle.

Advantageously, the first portion A is at least equal to 2*d*.

The section of the first portion A must be large enough to provide the required strength to the stopper around the attachment means. The skilled person knows from conventional stoppers the range of sections that are suitable for this purpose. The section of this portion can taper slightly towards the bottom end but preferably, it is substantially constant.

Preferably the first and third portions are kept as short as possible in order to increase the saving in material. Advantageously, the first portion will not exceed a length of 4 to 5*d* and the third portion will be limited to the stopper nose.

The essence of the present invention is thus that the second portion (B) is of reduced thickness with respect to the first (A) and third (C) portions.

The reduction in thickness of the second portion can be embodied by a substantially concave profile in vertical side-view. According to other embodiments, the second portion (B) has the form of an hyperboloid or of a simple taper.

However for the sake of easiness of manufacture and especially of demoulding, the second portion (B) comprises preferably a first sub-portion (B1) extending downwardly from the first portion (A) and having a section decreasing progressively and a second sub-portion (B2) extending from the bottom of the first sub-portion (B1) to the bottom of the second portion (B) and having a substantially constant section. In order to increase the material saving, it is preferred that the section decreases as rapidly as possible in the first sub-portion (B1). The taper should be such that the stress at any portion is no greater than that close to the attachment; conventional strength of materials calculation allows to determine the minimum sections necessary to achieve this result.

As is well known with conventional stoppers, the stopper according to the invention can be used with gas injection means so that a gas, preferably an inert gas, can be injected into the molten metal during the casting operations. Generally, in such a case, the gas is introduced into the axial bore of the stopper which conducts the gas to the lower end were it can be inject directly in the molten metal through a bore or a porous material.

According to the present invention, all form of attachments can be used such as a copressed metallic or ceramic insert, and the like.

As well known in the art, the stopper can include various parts of different composition (porous or erosion-resistant composition for the nose, slag resistant composition for a sleeve at the slag line, increased strength or permeability composition around the attachment).

The nose of the stopper of the invention can have any shape suitable for engagement in the throat of a corresponding exit nozzle. Optionally, it can be coated with a protective coating such as a glaze for example.

The stopper according to this invention can be manufactured according to conventional and well known processes for making refractory mono-block stoppers; such as isostatic pressing in an appropriate mould and demoulding, optionally followed by a step of machining the demoulded body.

One embodiment of the present invention will now be described by way of example with reference to the accompanying drawings in which:—

FIG. 1 is a schematic view of a prior art stopper, and

Figure 2:
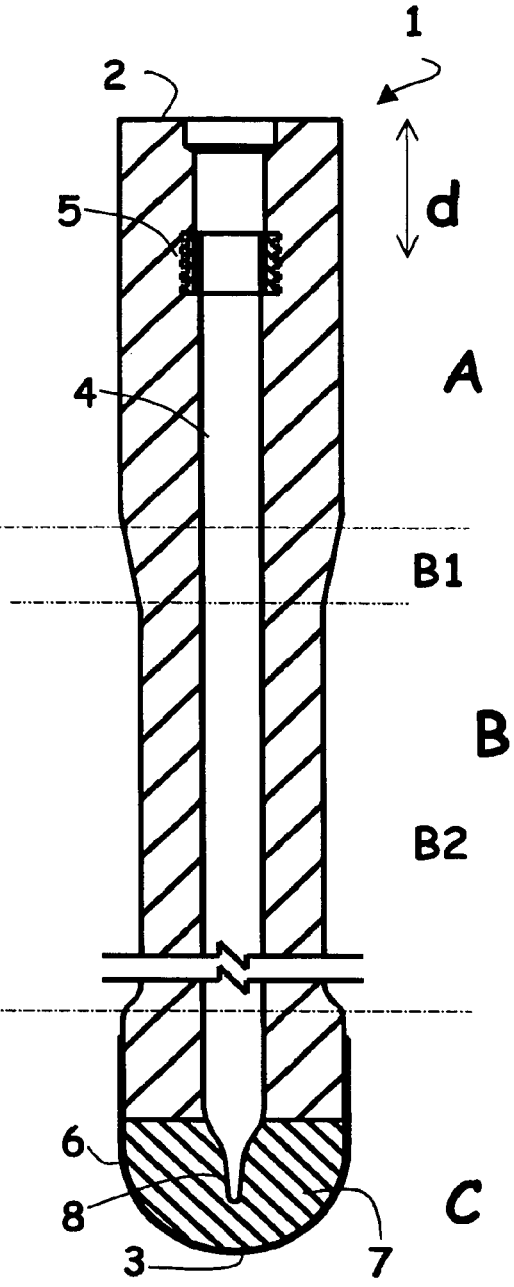
FIG. 2 is a schematic view of a stopper according to the invention.

FIG. 2 is a schematic view of a stopper according to the invention.

Turning now to the Figures, there is shown a stopper rod (1) for use in the control of flow of molten material from a tundish or vessel (not shown). The stopper rod (1) comprises a refractory body having an upper end (2), a lower end (3) and an axial bore (4) having a restricted portion in its lower region (8). An inert gas such as argon can be fed from a gas supply, through the axial bore in the upper region of the stopper rod. Attachment means (5) of the stopper to a lifting mechanism (not shown) are provided in a first portion A of the stopper in the axial bore (4) at a distance d from the upper end (2).

The third portion C includes the nose (6) which comprises injection means for the inert gas. The gas can be injected directly from the axial bore such as depicted on FIG. 1 or through a part 7 of the nose such as depicted on FIG. 2.

In the stopper of the prior art (FIG. 1), the second portion B is substantially cylindrical and has the same thickness as the first A and third portion C. In the stopper of the invention as depicted on FIG. 2, the second portion (B) has a reduced thickness.

In particular, the portion B has a first sub-portion B1 tapering rapidly to a reduced section and a second sub-portion B2 of substantially constant section.

The stopper of FIG. 2 has a weight 30% less than the weight of the stopper of FIG. 1 while having equivalent strength.

REFERENCES

1. Stopper
2. Upper end
3. Lower end
4. Axial bore
5. Attachment means
6. Stopper nose
7. Porous material
8. Axial bore in the nose

What is claimed is:

1. Refractory mono-block stopper of substantially cylindrical configuration comprising an upper end, a lower end and an inner surface defining an axial bore extending from the upper end towards the lower end, an attachment provided in the axial bore at a distance from the upper end, the stopper being divided into a) a first portion extending from the upper end towards the lower end, the first portion having a length longer than the distance and having a first cross-section;

b) a second portion extending from the first portion towards the lower end, the second portion comprising a second cross-section, where an average of the second cross-section is smaller than the first section; and c) a third portion extending from the second portion and comprising a stopper nose ending at the lower end of the stopper, the third portion having a third cross-section adjacent to the second portion that is larger than the second cross-section adjacent to the third portion.

2. Stopper of claim 1, wherein the third cross-section adjacent to the second section is greater than the average of the second cross-section.

3. Stopper of claim 1, wherein the length of the first portion is at least twice the distance.

4. Stopper of claim 1, wherein the first cross-section is substantially constant or tapers very slightly downwardly.

5. Stopper of claim 1, wherein the second portion includes a vertical cross-section from the first portion to the third portion.

6. Stopper of claim 5, wherein the vertical cross-section is substantially concave.

7. Stopper of claim 5, wherein the vertical cross-section progressively tapers.

8. Stopper of claim 5, wherein the vertical cross-section is substantially an hyperboloid.

9. Stopper of claim 1, wherein the second portion consists of:

a) a first sub-portion extending from the first portion and having a first sub-cross-section decreasing progressively; and b) a second sub-portion extending from the first sub-portion and having a second sub-cross-section that is substantially constant.

10. Stopper of claim 1, wherein the axial bore extends through the first and second portions.

11. Stopper of claim 1, wherein the stopper nose includes a gas injector.

12. Stopper of claim 1, wherein at least a part of the stopper nose comprises a porous material.

13. Stopper of claim 1, wherein the axial bore extends through the first and second portions and at least a part of the third portion.

* * * * *